US005931560A

United States Patent [19]

Hoffman

[11] Patent Number: 5,931,560

[45] Date of Patent: Aug. 3, 1999

[54] FLASHLIGHT HAVING FLEXIBLE, MEMORY-RETAINING MEMBERS

[76] Inventor: Edward J. Hoffman, 2/F, Flat A, 21 Sampan Street, Wanchai, The Hong Kong Special Administrative Region of the People's Republic of China

[21] Appl. No.: 08/832,456

[22] Filed: Mar. 3, 1997

[51] Int. Cl.[6] ..... F21P 1/02

[52] U.S. Cl. ..... 362/124; 362/190; 362/191; 362/202; 362/208; 362/285; 362/808

[58] Field of Search ..... 362/124, 189, 362/190, 191, 196, 197, 202, 208, 285, 287, 253, 418, 806, 808, 457, 458; 446/485; D26/34, 46, 98, 99, 100

[56] References Cited

U.S. PATENT DOCUMENTS

| | | | |
|---|---|---|---|
| D. 155,094 | 9/1949 | Lewis | D48/24 |
| D. 169,393 | 4/1953 | Rockmore . | |
| D. 173,704 | 12/1954 | Klotz, Jr. | D48/24 |
| D. 175,512 | 9/1955 | Klotz, Jr. | D48/24 |
| D. 175,513 | 9/1955 | Klotz, Jr. | D48/24 |
| D. 175,514 | 9/1955 | Klotz, Jr. | D48/24 |
| D. 176,465 | 12/1955 | Klotz, Jr. | D48/24 |
| D. 299,377 | 1/1989 | Garcia | D22/134 |
| D. 363,803 | 10/1995 | Kelly | D26/60 |
| 641,463 | 1/1900 | Muller . | |
| 1,454,530 | 5/1923 | Arnold . | |
| 1,842,401 | 1/1932 | Hamblet . | |
| 2,370,601 | 2/1945 | Wimpfheimer et al. . | |
| 2,706,610 | 4/1955 | Roberts | 248/168 |
| 3,604,914 | 9/1971 | Gibson | 240/2 R |
| 4,408,260 | 10/1983 | Miedel | 362/32 |
| 4,739,457 | 4/1988 | Orr | 362/287 |
| 4,897,768 | 1/1990 | Thul | 362/191 |
| 5,434,761 | 7/1995 | Lesnick et al. | 362/189 |
| 5,545,072 | 8/1996 | Arad et al. | 446/268 |

FOREIGN PATENT DOCUMENTS

| | | |
|---|---|---|
| 1 384 102 | 2/1975 | United Kingdom . |
| 2 071 300 | 9/1981 | United Kingdom . |

*Primary Examiner*—Sandra O'Shea
*Assistant Examiner*—Michael J. Smith
*Attorney, Agent, or Firm*—Harness, Dickey & Pierce, P.L.C.

[57] ABSTRACT

A portable illumination device includes a plurality of flexible, memory-retaining members for supporting and suspending itself. In one form, the portable illumination device of the present invention is a novelty flashlight in which the plurality of flexible, memory-retaining members are four in number and configured to simulate arms and legs. The novelty flashlight has a generally cylindrical main body portion. A bulb is mounted in the main body portion for producing a source of light. In one mode of use, the illumination device can be suspended from a bar, hook or other structure, by wrapping one or more of the flexible, memory-retaining members about the structure. In another mode of use, the flexible, memory-retaining members can be used to support the illumination device upon a support surface. The flexibility of the flexible, memory-retaining members permit the direction of the source of light to be easily and quickly adjusted.

9 Claims, 3 Drawing Sheets

FLASHLIGHT HAVING FLEXIBLE, MEMORY-RETAINING MEMBERS

BACKGROUND OF THE INVENTION

1. Field of the Invention

The present invention relates to illumination devices. More specifically, the present invention relates to a portable illumination device particularly in the form of a novelty flashlight which has a plurality of flexible, memory-retaining members for selectively directing a source of light when the flashlight is suspended or supported.

2. Discussion

Portable illumination devices have been made in a variety of shapes and sizes. To a significant degree, known illumination devices are intended to be solely function, and not ornamental. For example, the most common type of known portable illumination device is referred to as a flashlight. As used herein, the term flashlight refers to a portable illumination device which is typically cylindrical in shape and has a bulb and a reflector at one end. The generally cylindrical shape makes it easy to grasp and to place in a pocket or the like, but presents disadvantages if a person needs to illuminate an object with the flashlight and simultaneously use both hands to manipulate the object. Numerous attempts to resolve this problem have been made, each of which present their own disadvantages.

Heretofore, a number of illumination devices have been utilized which, unlike flashlights, are not generally cylindrical. Such illumination devices typically have at least one flat side which permits the device to be rested on a supporting surface and to be pointed in a chosen general direction. Since the exact direction to which the illumination device points is limited by the surface upon which the it rests and a predetermined direction relative to the support surface, it may be difficult to direct these illumination devices in a desired direction. This disadvantage is often overcome by increasing the available light, which increases size, weight and cost of the illumination device. In addition, convenience is also reduced. With other known illumination devices, an adjustable bulb and/or reflector may be provided for selectively directing the light as need. Such known arrangements are generally complicated and expensive.

Another drawback associated with conventional, portable illumination devices is that they are not entertaining and/or attractive in appearance. In this regard, a portable illumination device, such as a flashlight, is of no assistance if it cannot be located at the time it is needed (e.g. during power failure). Since the majority of known devices are not aesthetically appealing, they are stored away in locations that are frequently forgotten. As a result, they cannot be easily located when needed.

One known construction for supporting an illumination device upon a support surface is shown and described in U.S. Pat. No. 4,739,457 to Orr. Orr teaches an illumination device support for use in combination with an illuminating device which has an adjustable light reflector. The support includes a pair of substantially rigid legs which are pivotally attached to a body of the illumination device through a pair of mounting brackets. In use, a source of light produced by the illumination device can be directed by selectively positioning the legs relative to the body. Additional adjustment of the light source is permitted with the reflector. Other known arrangements for adjustably supporting an illumination device upon a support surface are shown and described in U.S. Pat. Nos. 2,706,610 to Roberts and 4,897,768 to Thul.

U.S. Pat. No. 1,454,530 to Arnold discloses a portable illumination device which is adapted to be suspended both when in use and out of use. The device includes a supporting member in the form of a chain. One end of the chain is detachably connected to a contact member of the lamp by a hook. The other end of the supporting member is passed through an opening in a base cap.

Other known illumination devices, many of which are ornamental, are shown in U.S. Pat. Nos. 641,463 to Muller; 1,842,401 to Hamblet; 2,370,601 to Wimpfheimer et al.; 3,604,914 to Gibson; 4,408,260 to Miedel; 5,434,761 to Lesnick et al.; and U.S. Design Pat. Nos. D155,094 to Lewis; D169,393 to Rockmore; D173,704 to Klotz; D175,512 to Klotz; D175,513 to Klotz; D175,514 to Klotz; D176,465 to Klotz; D299,377 to Garcia; and D363,803 to Kelly.

SUMMARY OF THE PRESENT INVENTION

It is principally an object of the present invention to provide an improved illumination device which overcomes the disadvantages of known constructions, including but not limited to those specifically addressed above.

It is another object of the present invention to provide a novelty flashlight which includes a pair of poseable arms and a pair of poseable legs.

It is a more particular object of the present invention to provide a portable illumination device which includes a plurality of flexible, memory-retaining members, two of which are intended to simulate arms and two of which are intended to simulate legs.

The present invention comprises an improvement over prior known illumination devices, including, but not limited to those disclosed in the aforementioned patents. More particularly, the present invention provides a new and improved illumination device which includes a positioning arrangement for selectively directing a source of light. In the preferred embodiment, the positioning arrangement may be used in a first mode to support the illumination device on a support surface, such as a counter top, floor or the like, and in a second mode to suspend the illumination device from any of a number of objects.

In the broader aspects of the present invention, there is provided a positioning arrangement for a portable illumination device having a generally cylindrical main body portion defining a longitudinal axis. The positioning arrangement includes a pair of arms attachable to the illumination device substantially adjacent a first end of the main body portion. The positioning arrangement further includes a pair of legs attachable to the illumination device substantially adjacent a second end of the main body portion. Each arm of the pair of arms and each leg of the pair of legs is flexible and substantially memory-retaining.

In one particular form, the present invention provides a novelty flashlight which includes a generally cylindrical main body portion that defines a longitudinal axis. A bulb is mounted in the main body portion for producing a source of light. The novelty flashlight further includes a pair of poseable arms. Each of the poseable arms has a fixed end interconnected to the main body portion. Preferably, the novelty flashlight also includes a pair of poseable legs which similarly each include a fixed end interconnected to the main body portion.

In a more preferred form, the present invention provides an illumination device including a generally cylindrical main body portion that defines a longitudinal axis. A bulb is mounted in the main body portion for producing a source of light. The illumination device additionally includes a plurality of flexible, memory-retaining members. Each of the flexible memory, retaining-members includes a fixed end interconnected to the main body portion and a free end independently moveable relative to the main body portion. Preferably, the plurality of flexible, memory-retaining elements are four in number. The plurality of flexible, memory-retaining elements can be selectively employed in a first mode for suspending the illumination device and a second mode for supporting the illumination device.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

The present invention provides a positioning arrangement for an illumination device. While shown operatively arranged with a novelty flashlight, those skilled in the art will appreciate that the invention is not so limited in scope. In this regard, the teachings of the present invention will be understood to be readily adaptable for use with any of a number of illumination devices. The terms "arms" and "legs" are used to describe a preferred embodiment of the present invention which happens to be animated. It will be understood by those skilled in the art that in a broad sense, these terms are intended to encompass any type of appendage extending from the body of the flashlight, independent of location. In this broad sense, the terms "arms" and "legs" will be understood to be interchangeable.

Figure 1:
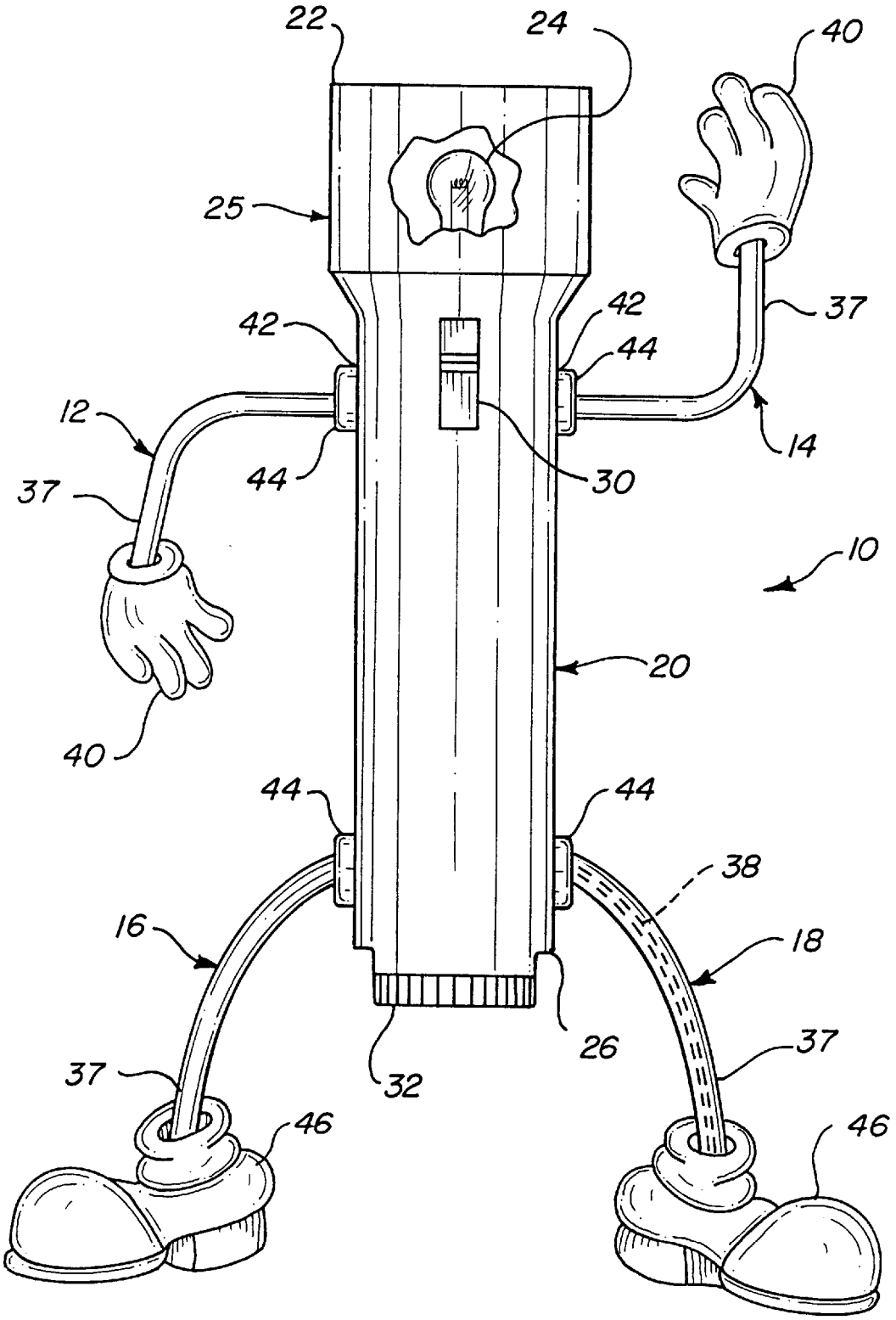
FIG. 1 is a partial cutaway, front view of a portable illumination device constructed in accordance with the teachings of the preferred embodiment of the present invention.

Turning to the drawings in which identical or equivalent elements have been denoted with like reference numerals, an exemplary device constructed in accordance with the teachings of the present invention is illustrated in FIG. 1 as an illumination device in the form of a novelty flashlight and is identified generally at reference numeral 10. As will become apparent below, the primary focus of the present invention is directed to a positioning arrangement for the illumination device 10.

In the exemplary embodiment illustrated, the positioning arrangement is shown to generally include a plurality of flexible, memory-retaining members identified in the drawings at reference numerals 12, 14, 16 and 18. Prior to addressing the specific construction and function of the flexible, memory-retaining members 12–18 of the positioning arrangement, an understanding of the cooperating portions of the illumination device 10 is warranted.

With specific reference to FIG. 1, the flashlight 10 of the exemplary embodiment is shown to include a substantially conventional main body portion 20 which is generally cylindrical in shape. However, it will be appreciated by those skilled in the art that any other shape may be used. In this same regard, it will be understood that the main body portion 20 can alternatively be in the shape of a character.

Adjacent a first end 22 of the flashlight 10, a bulb 24 is disposed within the main body portion 20. A cylindrical opening (not specifically shown) is provided at the first end 22 and a reflector (not shown) is positioned adjacent the bulb 24 for directing and concentrating a source of light produced by the bulb 24. The source of light is intended to exit the cylindrical opening in a direction substantially parallel to the longitudinal axis defined by the main body portion 20 of the flashlight 10. In the embodiment illustrated, the main body portion 20 of the illumination device 10 includes a first section 20*a* and a second section 20*b*.

In a substantially conventional manner, the main body portion 20 includes a removable section 25 or shroud. The bulb 24 and reflector are contained within the removable section 25. The removable section is preferably threadably attached to the remainder of the main body portion 20.

A source of power in the form of one or more batteries (not shown) is located within the main body portion 20 substantially adjacent a second end 26 thereof. The one or more batteries are electrically interconnected to the bulb 24. A manually operated switch 30 extends from the main body portion 20 and permits electrical power from the battery to be selectively transmitted to the bulb 24, thereby producing the source of light.

In one application, the main body portion 20 has a length of approximately 155 mm and a diameter of approximately 33 mm. However, it will be understood by those skilled in the art that significantly larger dimensions (or perhaps smaller dimensions) are anticipated by the present invention and should be considered to be within the scope hereof.

With continued reference to FIG. 1, the illumination device 10 of the present invention is shown to include an end cap 32 removably mounted at the second end 26 of the main body portion 20. In the exemplary embodiment, the end cap 32 threadably engages the second end 26 of the main body portion 20 and provides access a battery chamber (not shown) defined within the main body portion 20.

Figure 5:
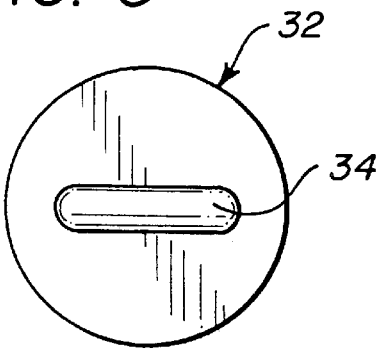
FIG. 5 is an end view of an alternative end cap for use with the illumination device of the present invention.
Figure 6:
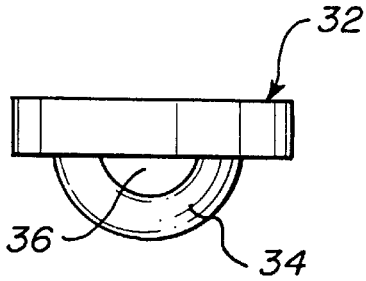
FIG. 6 is a side view of the end cap of FIG. 5.

Turning to FIGS. 5 and 6, an alternative construction of the end cap 32 of the present invention is illustrated. The alternative end cap 32 is shown to include generally C-shaped portion 34 which defines an aperture 36. The aperture 36 is specifically adapted to receive a key chain or fob (not shown). A string may also engage the aperture 36.

With continued reference to FIG. 1 and additional reference to FIGS. 2 through 4, the construction and operation of the plurality of flexible, memory-retaining members 12–18 of the positioning arrangement of the present invention will be described. In the exemplary embodiment illustrated, each of the flexible, memory-retaining members 12–18 includes an outer portion 36 preferable constructed of PVC or other suitable flexible material. Each of the flexible, memory-retaining members 12–18 also includes a memory-retaining wire 38 (shown in phantom with respect to member 18 in FIG. 1) located within the outer portion 36 and extending substantially along the entire length thereof.

The flexible, memory-retaining members 12–18 of the exemplary embodiment are arranged in pairs to include a first pair 12 and 14 and a second pair 16 and 18. The first pair 12 and 14 is disposed on the main body portion 20 of the illumination device 10 so as to animate the illumination device 10 with a pair of arms. Further to this end, the outer portions 36 of the flexible, memory-retaining members of the first pair 12 and 14 are unitarily constructed of PVC to include a distal end 40 in the shape of an animated hand or glove.

Figure 7:
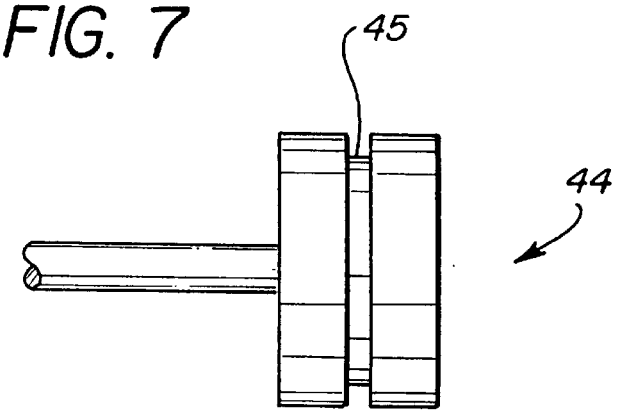
FIG. 7 is a side view of one of the mounting members of FIG. 1.

At a proximal end, or fixed end 42, the outer portions 36 of the flexible, memory-retaining members 12 and 14 are further unitarily formed to include mounting portions 44. One of the mounting portions 44 is shown in side view in FIG. 7. The mounting portions 44 are preferably non-rotatably captured between two halves of the main body portion 20. To this end, the mounting members 44 each include a reduced central portion 45 for receiving the first and second sections 20*a* and 20*b* of the main body portion 20. Alternatively, the mounting portions 44 may be permanently attached to the main body portion 20 of the illumination device 10 in any of a number of other manners well known in the art.

In a similar manner, the outer portions 36 of the flexible, memory-retaining members 16 and 18 of the second pair are disposed on the main body portion 20 to further provide animation to the illumination device 10. The outer portions 36 of the flexible, memory-retaining members 16 and 18 are unitarily constructed of PVC to include a distal end 46 in the shape of a foot or shoe. The outer portions 36 of the flexible, memory-retaining members 16 and 18 are formed to include mounting portions 44 substantially identical to the mounting portions 44 of the flexible, memory-retaining members 16 and 18, which are captured between the two halves of the main body portion 20.

In the particular application discussed above, the length of the pair of arms 12 and 14 is approximately 55 mm. In this same application, the length of the pair of legs 16 and 18 is approximately 60 mm. Again, it will be understood that these exemplary dimensions are provided for purpose of illustration and are readily subject to modification.

It will be understood by those skilled in the art that the flexible, memory-retaining members 12–18 need not be animated. In this regard, it should be considered that any type of flexible, memory-retaining member is within the scope of the present invention.

Figure 2:
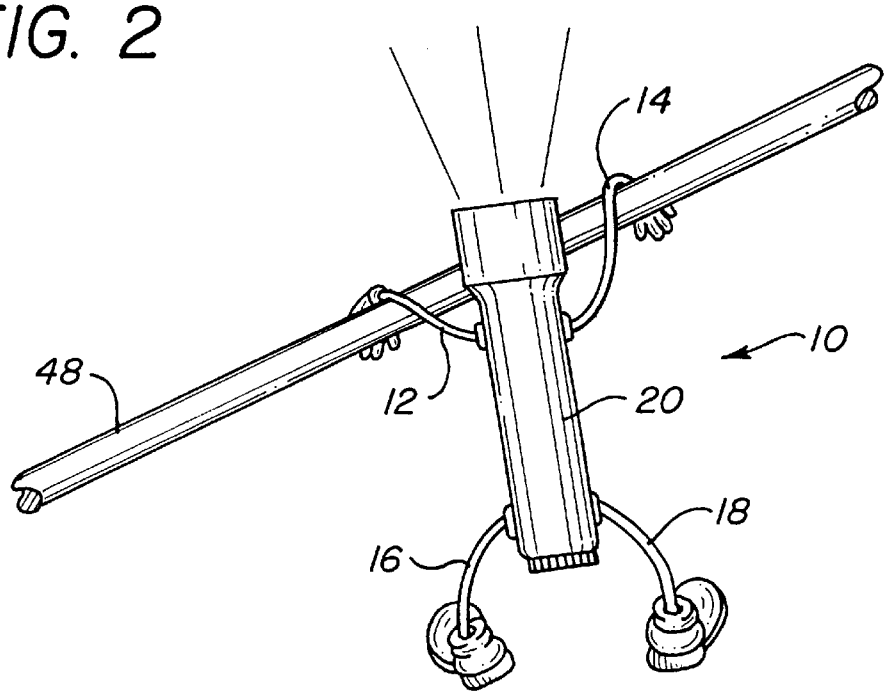
FIG. 2 is a simplified front view of the portable illumination device of FIG. 1 illustrated in a first mode of use suspended from a bar for directing its lights source generally upward.
Figure 3:
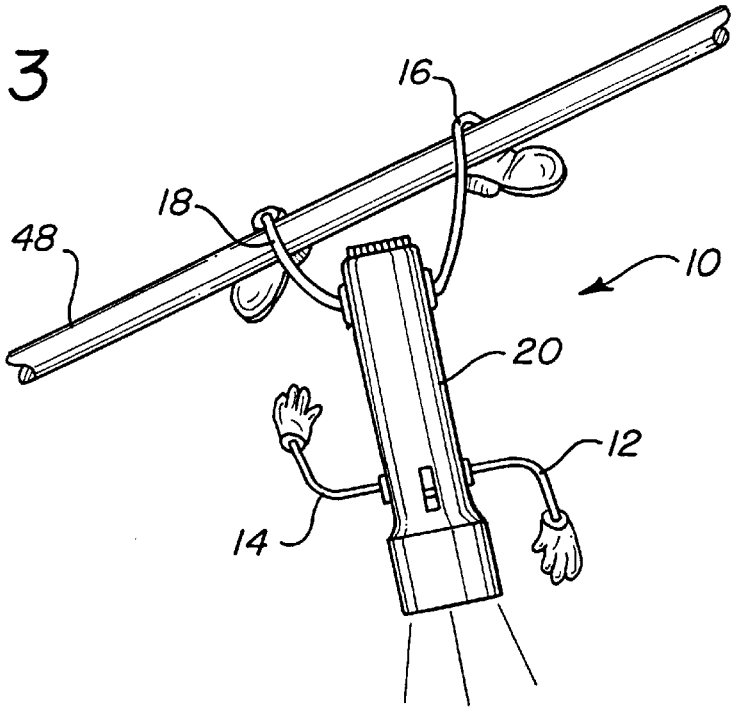
FIG. 3 is a simplified front view similar to FIG. 2, illustrating the portable illumination device suspended from the bar so as to direct its source of light generally downward.
Figure 4:
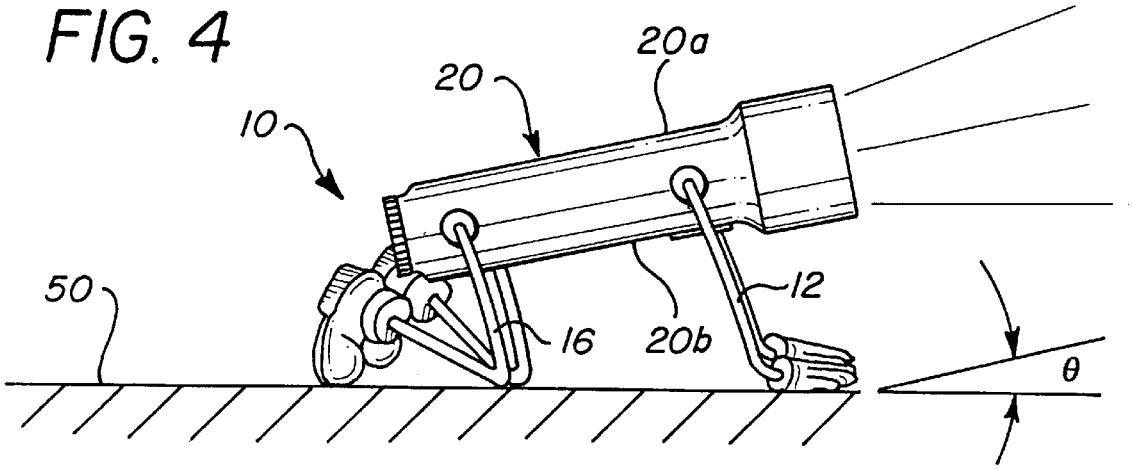
FIG. 4 is a simplified side view of the portable illumination device of FIG. 1 illustrated in a second mode of use supported on a support surface for directed its light source in a predetermined direction.

With particular reference to FIGS. 2, 3, and 4, exemplary uses of the illumination device 10 heretofore detailed will now be described. The illumination device 10 is operable in a first mode (as shown in FIG. 2) for suspension from a rod 48 or other structure. As illustrated, in FIG. 2, at least one, and preferably both, of the first pair of flexible, memory-retaining members 12 and 14 (e.g. the pair of arms 12 and 14) are wrapped around the rod 48. Due to the memory-retaining capability of the pair of arms 12 and 14, the illumination device 10 can be thereby suspended so as to upwardly direct the source of light. In this manner, the operator can use both of his or her hands to perform a desired task. It will be understood that while FIG. 2 shows the source of light directed substantially vertical, adjustment therefrom is permitted through the flexible engagement of the pair of arms 12 and 14 with the rod 48.

As shown in FIG. 3, the illumination device 10 can also be operated in the first mode so as to direct the source of light in a substantially downward direction. In this manner, the second pair of memory-retaining members 16 and 18 (e.g. the pair of legs 16 and 18) are wrapped around the rod 48 or other structure.

Turning to FIG. 4, the illumination device 10 of the present invention is operative in a second mode supported upon a support surface 50, such as a counter top, floor, or other generally horizontal surface. In this mode, the illumination device 10 is supported by all four of the flexible, memory-retaining members 12–18 for directing the source of light at an angle θ relative to the support surface 50. The angle θ is readily changed by adjusting the effective length of the pair of legs 16 and 18 relative to the effective length of the pair of arms 12 and 14.

The illumination device 10 can also balance on the pair of legs 16 and 18, as shown in FIG. 1. While not shown, it will be further understood that the illumination device can balance on one of the pair of legs 16 and 18.

Thus, it will be understood that the illumination device 10 of the present invention which can be easily positioned for car repairs, camping and countless other applications. The present invention also provides an illumination device 10 which is not subject to rolling of a planar surface, such as a counter top.

While the above description constitutes the preferred embodiment of the invention, it will be appreciated that the invention is susceptible to modification, variation, and change without departing from the proper scope or fair meaning of the accompanying claims. For example, the illumination device 10 additionally include a flexible, memory-retaining member which has the appearance of a tail. Additionally, it will be understood that the illumination device 10 may alternatively include only two flexible members, three flexible members, or more than four flexible members. Furthermore, the illumination device 10 may be modified for carrying from a belt or the like.

What is claimed is:

1. A positioning arrangement for selectively directing a source of light from a portable illumination device having a generally cylindrical main body portion defining a longitudinal axis, the positioning arrangement comprising:

a pair of arms attachable to the illumination device substantially adjacent a first end of the body; and a pair of legs attachable to the illumination device substantially adjacent a second end of the body;

each arm of said pair of arms and each leg of said pair of legs being flexible and memory retaining.

2. The positioning arrangement for selectively directing a source of light from a portable illumination device of claim 1, wherein said arms of said pair of arms extend from circumferentially opposing sides of the main body portion of the illumination device.

3. The positioning arrangement for selectively directing a source of light from a portable illumination device of claim 1, wherein both arms of said pair of arms and both legs of said pair of legs includes a fixed end attachable to the main body portion and a free end independently moveable relative to a respective one of said first ends.

4. The positioning arrangement for selectively directing a source of light from a portable illumination device of claim 1, wherein both arms of said pair of arms and both legs of said pair of legs includes a first end attachable to the main body portion and a second end independently moveable relative to a respective one of the first ends.

5. The illumination device comprising:

a generally cylindrical main body portion defining a longitudinal axis;

a bulb mounted in said main body portion for producing a source of light; and a plurality of flexible, memory-retaining members each including a fixed end interconnected to said main body portion and a free end independently moveable relative to said main body portion, said plurality of flexible memory-retaining members including a first pair of flexible memory-retaining members attached to said main body portion adjacent a first end thereof and a second pair of flexible memory-retaining members attached to said main body portion adjacent a second end thereof:

whereby the plurality of flexible, memory-retaining members may be selectively employed in a first mode for suspending the illumination device and a second mode for supporting the illumination device.

6. A novelty flashlight comprising:

a generally cylindrical main body portion defining a longitudinal axis;

a bulb mounted in said main body portion for producing a source of light;

a pair of poseable arms, each poseable arm of said pair of poseable arms having a fixed end interconnected to said main body portion, and a pair of poseable legs having a fixed end interconnected to said main body portion.

7. The novelty flashlight of claim 6, wherein each poseable arm of said pair of poseable arms and each poseable leg of said pair of poseable legs includes a free end moveable relative to its fixed end.

8. An animated illumination device comprising:

a generally cylindrical main body portion defining a longitudinal axis;

a bulb mounted in said main body portion for producing a source of light; and a first pair of flexible, memory-retaining members both including a fixed end interconnected to said main body portion and a free end independently movable relative to said main body portion, said first pair of flexible, memory-retaining members configured to be either a pair of animated arms or a pair of animated legs.

9. The animated illumination device of claim 8, further comprising a second pair of flexible, memory-retaining members configured as the other of said pair of animated arms or said pair of animated legs.

* * * * *